United States Patent [19]

Watson

[11] Patent Number: 4,613,130

[45] Date of Patent: Sep. 23, 1986

[54] RESILIENT THERAPEUTIC DEVICE WITH TIMER AND INDICATOR

[76] Inventor: Harold K. Watson, 600 Wolcott Hill Rd., Wethersfield, Conn. 06109

[21] Appl. No.: 755,565

[22] Filed: Jul. 16, 1985

[51] Int. Cl.[4] ..... A63B 21/02

[52] U.S. Cl. ..... 272/135; 272/68; 272/DIG. 5; 73/379; 128/26

[58] Field of Search ..... 272/67, 68, DIG. 5, 272/135, 129; 128/26, 774, 779, 782; 73/379, 380, 381; 340/323 R

[56] References Cited

U.S. PATENT DOCUMENTS

| | | | |
|---|---|---|---|
| 3,132,861 | 5/1964 | Horney | 272/68 |
| 3,596,907 | 8/1971 | Brighton et al. | 73/380 R |
| 4,199,987 | 4/1980 | Bauers et al. | 73/379 |
| 4,433,364 | 2/1984 | Noble | 362/109 |

FOREIGN PATENT DOCUMENTS

| | | | |
|---|---|---|---|
| 226083 | 1/1969 | U.S.S.R. | 73/379 |

*Primary Examiner*—Richard J. Apley
*Assistant Examiner*—John L. Welsh
*Attorney, Agent, or Firm*—Prutzman, Kalb, Chilton & Alix

[57] ABSTRACT

An exercise device for use in dystrophy therapy employs a compression spring which provides an adjustable resistance force. Manual application of a push-type force to a handle actuates a cumulative timer circuit for recording the elapsed time at which an exerted force exceeds a pre-established threshold force. The exercise device may also be converted to a pull mode wherein a pull force exerted between a plate and a handle connecting the exercise device actuates a cumulative timer circuit. The threshold force is adjustable by changing the axial position of the compression spring seat.

5 Claims, 4 Drawing Figures

RESILIENT THERAPEUTIC DEVICE WITH TIMER AND INDICATOR

BACKGROUND OF THE INVENTION (1) Field of the Invention

This invention relates generally to exercise devices employed in therapeutic programs. More particularly, the present invention relates to an exercise device which is adapted to function in conjunction with the manual application of a moderate pre-established force for an extended time interval.

In therapeutic programs such as those employed in the treatment of hand dystrophies, a common exercise program involves the application of a force at a certain force threshold for an extended time interval so that specific groups of muscles such as hand and arm muscles may be exercised throughout a defined interval of time. Such exercise programs may involve sequential repetition over a pre-established period of time at increasing force thresholds to gradually strengthen the muscular response. Accordingly, a principal aim of the present invention is to provide a new and improved exercise device which is specifically adapted for therapeutic exercise programs which require the application of a pre-established moderate force for a given time interval at incrementally increasing force thresholds.

(2) Prior Art

A number of exercise devices are directed to various aspects and configurations for use in conjunction with manually applied compressive forces. U.S. Pat. Nos. 2,680,967, 3,365,947 and 3,848,468 generally exemplify exercise devices directed to the measurement of a manually applied compressive force. A number of exercise devices are also directed to devices wherein a clock or timer mechanism is activated in conjunction with the operation of the exercise device. U.S. Pat. No. 4,463,946 discloses an exercise device which employs a pivotal balance beam on which a test subject stands and wherein a clock mechanism is actuated during the operation of the exercise device.

BRIEF SUMMARY OF THE INVENTION

Briefly stated, the invention in a preferred form is an exercise device for use in various forms of hand therapy. The exercise device comprises a compression spring mechanism which is adapted to provide a variable resistance force to a manually applied compression force exerted against one of the opposing ends of the mechanism. A platform structure seats one end of the spring mechanism. The other end of the spring mechanism is seated within a handle which is adapted to facilitate manual application of the compressive force. A variably axially positionable spring seat is adjustable to vary the resistance force of the compression spring mechanism. When a compressive force is applied to the handle at a force level which exceeds a pre-set resistance force, a switch actuates a timer for recording the cumulative elapsed time that the manually applied force exceeds the pre-established threshold. A removable indicator shaft is axially responsive to the position of a spring seat to indicate the pre-selected resistance force of the compression spring. In addition, an indicator light visually indicates when a compressive force applied to the handle exceeds the threshold force.

The exercise device is also adaptable for conversion to a pull-mode configuration wherein a second handle is connected to the housing and a plate is suspended from the housing by means of a connector. The connector is anchored at opposite sides of the housing so that a force exerted between the second handle and the plate exerts a resultant compressive force on the compression spring mechanism.

An object of the invention is to provide a new and improved exercise device for use in hand therapy.

Another object of the invention is to provide a new and improved exercise device of efficient construction which may be easily employed by a patient to provide a ready visual indication of the ongoing progress of a patient with a given exercise subroutine.

A further object of the invention is to provide a new and improved exercise device which is responsive to the manual application of a force to indicate the cumulative time interval within which the manually applied force exceeds a pre-established force threshold.

Other objects and advantages of the invention will become apparent from the drawing and the specification.

DETAILED DESCRIPTION OF THE INVENTION

Figure 1:
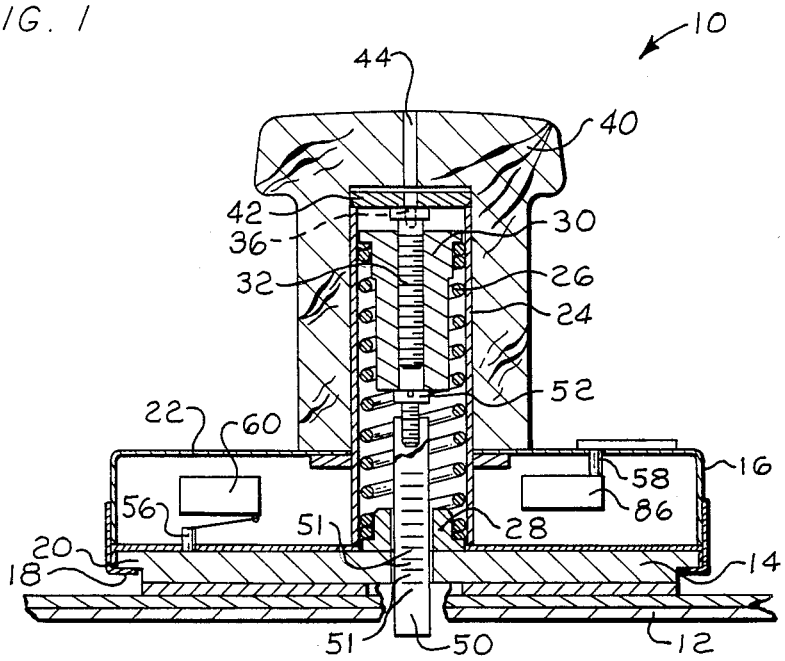
FIG. 1 is a side sectional view partly in section and partly broken away, of an exercise device of the present invention in a push mode configuration taken along the line 1—1 of FIG. 4.

With reference to the drawing wherein like numerals represent like parts throughout the FIGURES, an exercise device in accordance with the present invention is generally designated by the numeral 10. Exercise device 10 is adapted for ready conversion from a push mode configuration illustrated in FIG. 1 to a pull mode configuration illustrated in FIG. 2. Exercise device 10 is especially adapted for use in hand dystrophy therapy wherein it is desired to have a patient exert a moderate push or pull-type force equal to or in excess of a pre-established threshold level for a pre-established period of time and/or to measure the cumulative time during which the patient exerts such a force.

With reference to FIG. 1, exercise device 10 is of a light weight, compact portable form which is preferably positioned in upright fashion on a planar support base 12. A substantially rectangular platform 14 mounts a substantially rectilinear-shaped housing 16 which is vertically displaceable relative to the platform as will be further described below. Housing 16 encloses electrical circuitry for the exercise device. Housing 16 connects with a lower peripheral circumferentially extending skirt 18 having a substantially L-shaped section. Skirt 18 forms a lower inwardly directed flange which cooperates with the underside of an upper peripheral shoulder 20 of the platform to form an upper vertical stop which limits vertical movement of the housing relative to the platform. The upper panel of the housing forms a substantially rectangular compression plate 22 having a dimension in one form of the invention of approximately $6\frac{1}{8}'' \times 6\frac{1}{8}''$.

A steel sleeve 24 is centrally mounted at the top of platform 14 and extends vertically through a central opening of the compression plate 22. Sleeve 24 receives a steel coil spring 26 which provides a variable compressive resistance in accordance with the axial expansion of the spring. Spring 26 is seated at its lower end against the platform by means of a locator seat 28. The upper end of the spring is seated by an upper spring seat 30. Upper seat 30 includes a central threaded bore which is threadably engageable with a threaded bolt 32 for axially adjusting the position of the upper seat, and hence the resistance force of the coil spring 26. Bolt 32 includes a hexhead socket 36 for engaging the bolt for rotation thereof to axially set the position of spring seat 30.

A handle 40 is mounted at the top of compression plate 22. Handle 40 is dimensioned and configured for grasping by the hand of a patient and has a quasi-T-shaped section to accomplish the foregoing function. Handle 40 contains a central bore for receiving sleeve 24. Handle 40 may be formed from wood and covered with a cloth or plastic material (not illustrated). In a preferred form of the invention the handle is approximately $3\frac{1}{2}$ inches high with maximum transverse dimension of $3\frac{1}{8}$ inches at the top. Handle 40 extends uniformly from the front side of the compression plate to the opposite rear side. A vertically extending central bore is formed in the handle 40. An upper end of the bore receives an annular plate 42 which engages sleeve 24 and the top of bolt 32 for fixing the axial position of the upper seat 30. A narrow vertically extending bore 44 leads from the top of the handle to the enlarged bore to provide access for engaging the hexhead socket 36.

A removable indicator shaft 50 cooperates with the lower axially protruding locator end of the upper seat 30 to form a removable load gage for indicating the pre-set resistance threshold setting of coil spring 26. Shaft 50 is a four-sided elongated member wherein each side includes a staggered series of indicator marks 51 for indicating the position of the upper spring seat and hence the compressive resistance of the spring in accordance with the alignment of the indicator marks with a corresponding scale mark or window (not illustrated). In preferred form, the indicator marks 51 form a graduated scale in two pound increments from 0 to 76 pounds with each shaft side being graduated in eight pound increments. A calibration screw 52 is threaded into the top of the shaft to provide an axial adjustment for calibrating the scale with the resistance threshold setting of the coil. Indicator shaft 50 extends through a central square opening formed in the lower locator seat 28 and the platform 14. Base 12 is broken away in FIG. 1 to illustrate the removable load gage in a mounted configuration.

A pin 56 projects upwardly from platform 14 to extend through an opening in the bottom panel of housing 16. A single pole, single throw switch 60 is mounted in fixed relation to housing 16 to actuate a timer 62 when a force applied to the handle exceeds the compression resistance force of the coil spring.

Figure 3:
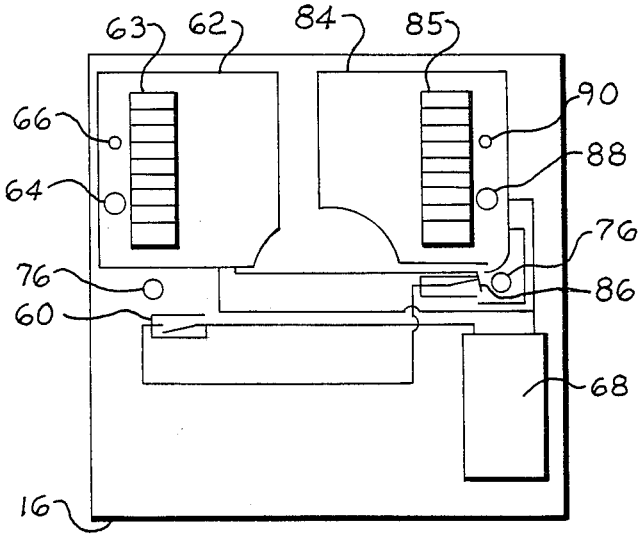
FIG. 3 is a schematic diagram of the exercise device of FIG. 1.
Figure 4:
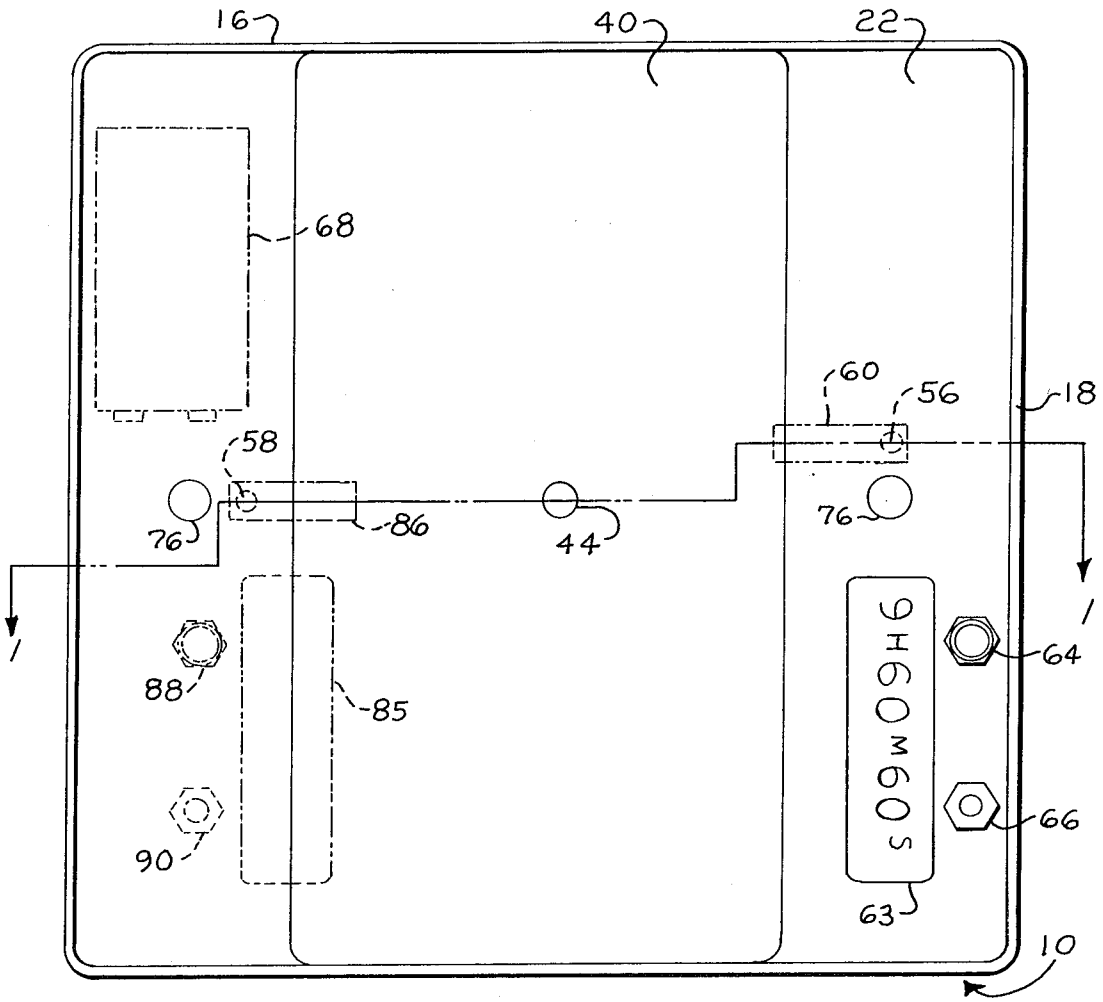
FIG. 4 is a top plan view, partly in phantom, of the exercise device of FIG. 1.

With additional reference to FIGS. 3 and 4, housing 16 is vertically downwardly displaceable so that pin 56 depresses switch 60 to actuate the timer. The maximum displacement distance between the fixed platform 14 and the housing 16 from a zero load applied to handle 40 to a maximum load applied to handle 40 is ordinarily only approximately 1/16 inch. An indicator light 64 is connected in parallel with the timer so that the indicator light is on when the timer is operating. The timer 62 preferably has the form and function of a basic stop watch having a liquid crystal display (LCD) 63 which indicates hours, minutes and seconds. The timer measures cumulative elapsed time. A re-set button 66 may be manually actuated to remove power from the timer to re-set the timer to zero. The timer circuit is powered by a standard 1.5 volt battery 68. As illustrated in FIG. 4, the LCD 63, indicator light 64, and reset button 66 are located at the top panel of the housing for ready access by the patient.

In operation, the exercise device is initially pre-set for use by adjusting the compressive resistance of the coil spring 26. A hexwrench is inserted through opening 44 to engage the hexhead socket 36 for axially adjusting the upper spring seat and hence fixing the threshold compressive resistance. In a preferred form of the invention, the compressive resistance force can be adjustably varied from 3 to 75 pounds. The patient then grasps the handle 40 and applies a push (axially compressive) force against the handle. When the applied force exceeds the pre-established compressive resistance threshold, the housing is displaced downwardly a sufficient distance so that pins 56 actuates switch 60 to start the operation of the cumulative timer 62. The indicator light 64 is also energized by the activation of switch 60. The timer continues to operate and display the cumulative elapsed time at LCD 63 as long as the applied force exceeds the pre-established threshold resistance force. In the event that the applied force decreases below the threshold force, the cumulative timer ceases operation. When a force is reapplied by the patient to exceed the threshold force, the timer continues to accumulate the time commencing with the elapsed time immediately preceding the termination of operation. The timer is re-set to zero upon manually pressing the re-set switch 66.

Figure 2:
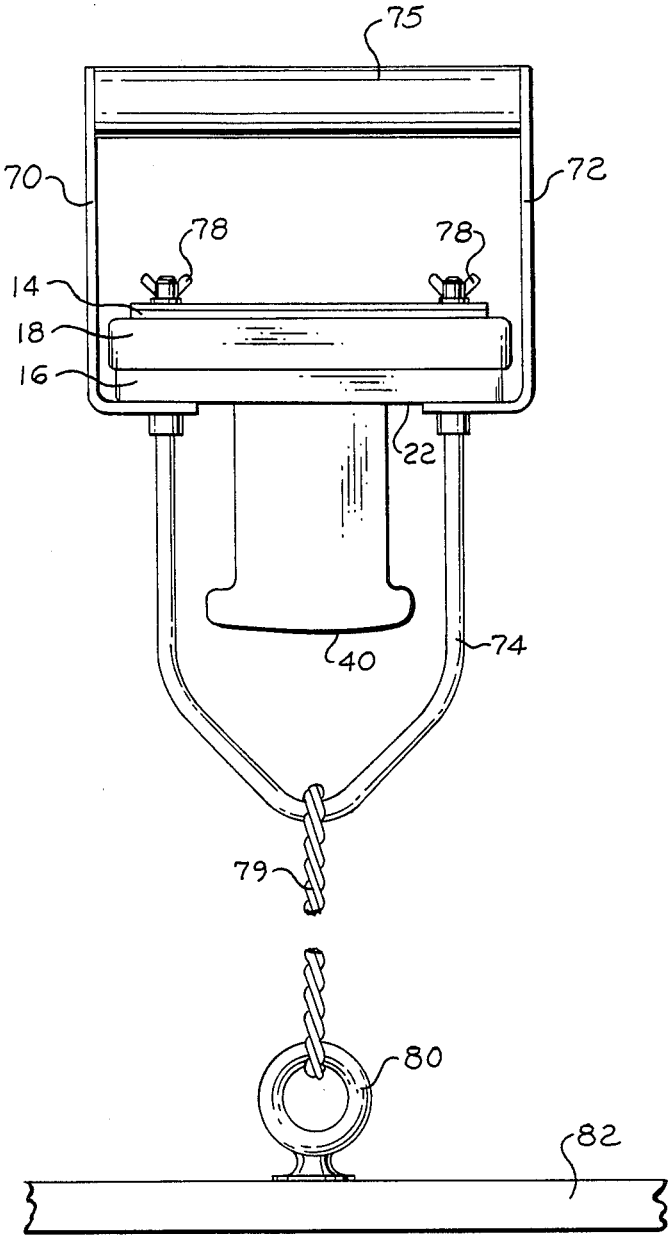
FIG. 2 is a fragmentary side perspective view of a pull mode configuration of the exercise device of FIG. 1.

The foregoing exercise device may also be readily converted to a pull-type exercise mode as illustrated in FIG. 2. The orientation of the exercise device is inverted relative to the orientation of FIG. 1. A pair of L-shaped brackets 70 and 72 engage the top of the compression plate 22 for mounting a handle 75 which extends in spaced relationship from the platform. A U-shaped bracket 74 extends through slots in brackets 70 and 72 and a pair of spaced openings 76 formed in the housing. Bracket 74 and captured brackets 70 and 72 are secured by a pair of wing nuts 78 which tighten against the platform 14. An adjustable length wire cord 79 connects bracket 74 with a ring 80 extending from a load plate 82. The patient either stands on plate 82 or a weight load is placed on plate 82 with the resulting load force being transferred via bracket 74 to act downwardly against platform 14. A pull force exerted outwardly (upwardly) between handle 75 and plate 82 which is stationary results in a compression force exerted on the exercise device between compression plate 22 of the housing and platform 14. The foregoing adaptation is employed so that exercise device 10 may also be used in conjunction with pull-type exercises.

A second cumulative timer 84 for the pull mode commences operation upon a second pin 58 actuating a switch 86 which is generally similar to switch 60. Pin 58 is mounted in fixed relationship to perform 14. Timer 84 has an associated LCD 85. In addition, a pull mode indicator light 88 and a pull mode re-set switch 90 are employed respectively, for visually indicating when the pull force applied between handle 74 and plate 82 exceeds the pre-established threshold force of the exercise device and for re-setting the pull mode cumulative timer 84. In preferred form, LCD 85 and indicator light 88 are visually accessible through or at the top of platform 14 for the pull mode configuration of FIG. 2. Reset switch 90 may also be located for access at the top (as viewed in FIG. 2) of platform 14. The resistance threshold force of the spring 26 is pre-set in the same manner as for the push mode configuration of FIG. 1.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An exercise device for use in dystrophy therapy comprising:

a platform having a base adapted to be placed on a horizontal surface and a cover vertically displaceable relative to the base and forming in cooperationg with said base a housing with said cover defining a generally horizonally extending upper surface;

handle means mounted in fixed relationship to said cover and extending generally vertically therefrom to upwardly terminate in an application surface to facilitate application of a downward force through a hand forced against said application surface, said application surface having an area which is substantially less than the area of the upper surface of said cover;

compression spring means enclosed in said formed housing and said handle means and having opposing biasing ends to provide a variable resistance force to a force of compression exerted between said opposing ends, one said end being seated against a first seat mounted in pre-established relationship with said base, the other said end being seated against a second seat mounted in pre-established relationship with said handle means;

one said seat being a variably positionable seat to adjustably vary the resistance force of said compression spring means;

adjustment means to selectively pre-set the position of said adjustable seat;

timer means to record cumulative elapsed time and present a visual display thereof at said cover upper surface; and switch means enclosed in said formed housing to activate said timer means when a compressive force applied at said application surface and exerted between said handle means and base exceeds said pre-set resistance force and to deactivate said timer means when said compressive force does not exceed said pre-set resistance force.

2. The exercise device of claim 1 wherein said compression spring means comprises a coil spring having a compression force which varies in accordance with the degree of axial compression of said spring.

3. The exercise device of claim 1 wherein said spring adjustment means further comprises an adjustment screw which threadably engages said positionable spring seat to axially displace said seat upon rotation of said screw.

4. The exercise device of claim 1 further comprising a shaft axially responsive to the position of said spring seat to indicate the pre-set resistance force of said compression spring.

5. The exercise device of claim 1 further comprising indicator light means to visually indicate when a compression force applied to said handle means exceeds the pre-set resistance force.

* * * * *